United States Patent [19]

Smith

[11] 4,440,263

[45] Apr. 3, 1984

[54] ATTACHMENT TO A LADDER

[76] Inventor: Samuel D. Smith, "Jamada", Newton of Pitcairns, Dunning, Perthshire, Scotland

[21] Appl. No.: 277,829

[22] Filed: Jun. 26, 1981

[30] Foreign Application Priority Data

Jul. 30, 1980 [GB] United Kingdom ..... 8024955
May 13, 1981 [GB] United Kingdom ..... 8114650

[51] Int. Cl.[3] ..... E06C 7/16; E06C 7/48

[52] U.S. Cl. ..... 182/121; 182/214; 182/107; 248/238

[58] Field of Search ..... 182/214, 121, 122, 108, 182/107; 248/238, 23 S

[56] References Cited

U.S. PATENT DOCUMENTS

| | | | |
|---|---|---|---|
| 1,645,879 | 10/1927 | Skeels | 182/121 |
| 3,072,218 | 1/1963 | Peters | 182/214 |
| 3,318,416 | 5/1967 | Robinson | 182/214 |
| 3,773,143 | 11/1973 | Del Prete et al. | 182/214 |
| 4,359,138 | 11/1982 | Kummerlin | 182/214 |

FOREIGN PATENT DOCUMENTS 1074780 7/1967 United Kingdom .

*Primary Examiner*—R. P. Machado
*Attorney, Agent, or Firm*—Warren B. Kice

[57] ABSTRACT

A ladder attachment includes a telescopic cross-bar 1A, 2A the ends of which carry wheels 3A for engaging a wall on either side of the ladder. This provides stability and also sets the ladder back from the wall.

The center portion 1A of the cross-bar has a pair of hooks 4A which hook over a rung 5A of the ladder and a pair of turnbuckles 9 which hook under a lower rung 12 (after which the turnbuckles 9 are tightened to secure the fixing). The turnbuckles are attached to a sleeve 10 carried by the bar 1A and have hooks 11.

A platform assembly 30 can also be mounted on the ladder and connected to the ladder attachment by support struts. The platform assembly includes a support framework 32 in which slots 33 are provided to overlie two rungs 34 and a turnbuckle 35 tightens the framework against the ladder.

The ladder attachment can carry a pulley by which goods can be hoisted to the person working on the ladder.

The ladder attachment provides stability to the ladder and the platform, if used enables a greater area to be made available to the person on the ladder.

A spacer (50–55) device can be temporarily mounted at the top of the ladder to space it from a wall and permit fitment of the ladder attachment to the ladder.

7 Claims, 6 Drawing Figures

ATTACHMENT TO A LADDER

This invention relates to a device for attachment to a ladder, said device being of the kind disclosed in my prior U.S. Pat. No. 1,074,780.

In said U.S. Pat. No. 1,074,780, there is disclosed a device for use in conjunction with a ladder, the device comprising an elongate cross-bar whose length is greater than the width of the ladder, said cross-bar comprising a central tubular member and a pair of outer wall-engageable members telescopically mounted in the central member and adjustably locatable therein, and having attachment means for securing the cross-bar to a rung of a ladder, whereby the wall-engageable members are located transversely beyond the ladder.

The attachment means includes at least one hook-shaped member and at least two U-shaped brackets which are threaded at their end and carry a removable abutment plate thereon, and the wall-engageable members are wheels.

Fuller details of the known device, hot it is used, and its advantages may be obtained from my said patent to which reference is specifically directed.

An object of the present invention is to provide a modification of or improvement in the invention set forth in my patent aforesaid, whereby the device may be fitted more securely and more easily to the ladder, so that, in use, the ladder is more stable and safer.

In accordance with one aspect of the present invention, the U-shaped brackets and clamping plates are replaced by a pair of turnbuckles which at one end are mounted on said cross-bar, and at their other ends have hooks.

Accordance to another aspect of the present invention there is provided a ladder attachment comprising an elongate cross-bar whose length is greater than the width of the ladder said cross-bar comprising a central tubular member and a pair of outer wall-engageable members telescopically mounted in the central member and adjustablly locatable therein and attachment means mounted in the cross-bar for securing the cross-bar to at least two rungs of the ladder, said attachment means comprising at least one hook-shaped member for engaging one rung and a pair of turnbuckles which at one end are mounted on the cross-bar and at their other end have hooks for engaging another rung, such that the cross-bar lies between said two rungs.

In accrodance with another aspect of the invention there is provided for use in combination with the ladder attachment a platform assembly which includes a framework having recesses for engagement with the two rungs of the ladder below the level of the ladder attachment and supporting a platform member the structure also including support means connecting the platform assembly to the cross-bar.

Preferably, said support means comprises a pair of struts connected to the platform member and to bracket means mounted on the cross-bar.

Preferably also, the platform member is pivotal upwardly relative to the ladder and the struts are slidably located in the bracket means.

Preferably also, the platform member has a width approximately three times the width of the ladder.

In use, the or each first hook-shaped member engages over an upper rung of the ladder, and the hooks on the turnbuckles pass below the next lower rung and are brought into firm engagement therewith by turning the screw-threaded sleeves of the turnbuckles.

According to a further aspect of the present invention there is provided a spacer device for spacing the top of a ladder from a wall comprising a pair of plates engageable with the ladder sides at or adjacent the top of the ladder and carrying means which abut a wall when the ladder is placed thereagainst so that the top of the ladder is spaced from said wall.

An embodiment of the invention will now be described, by way of example, with reference to the accompanying drawing, in which.

Figure 1:
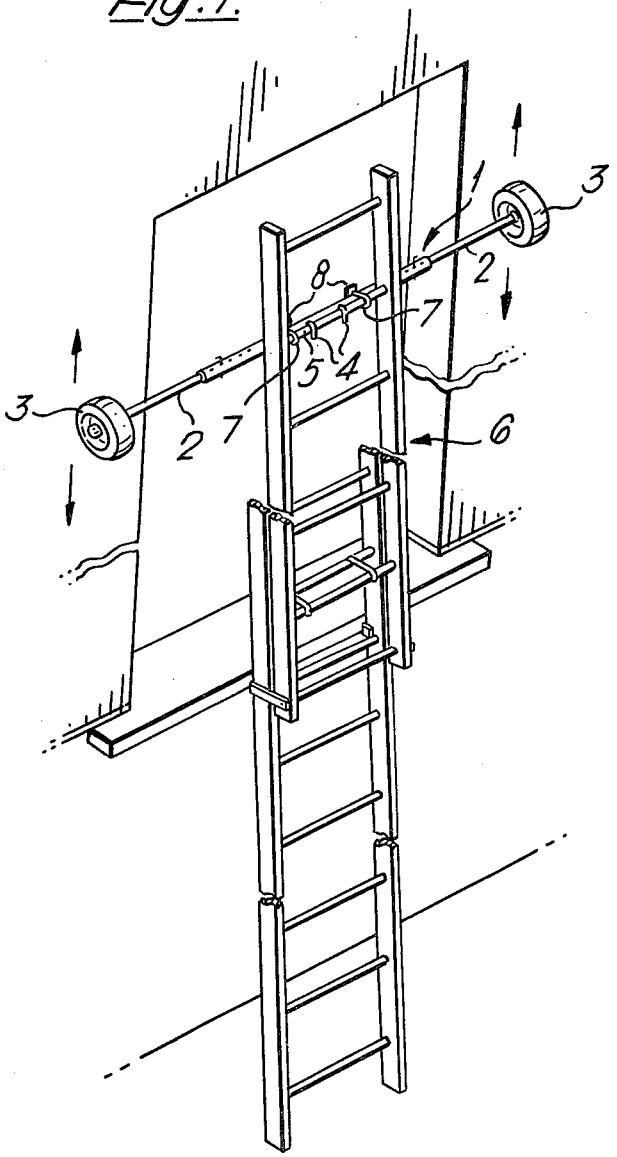
FIG. 1 is a perspective view of a ladder in combination with a device as disclosed in my Pat. No. 1,074,780.

Referring to FIG. 1 the known device consists generally of a tubular cross-bar comprising a central tubular member 1 having at each end a telescoping bar 2 carrying a rubbertyred 3. The bar 1 has a pair of fixed hook-shaped members 4 which engage over the second top rung 5 of the ladder 6. The bar 1 is secured in position by a pair of removable U-shaped brackets 7 which embrace the rung 5 and straddle the bar 1, and whose legs project through holes in clamping plates 8 and receive clamping wing nuts, not shown.

With such a device, it has been found that there is a tendency for the person fitting the device to the ladder to tighten the wing nuts only by hand, so that they are insufficiently tight and tend to work loose. As a result, the device may cant relative to the ladder, or the ladder may rock relative to the device and make the ladder unstable. Also, as the U-bolts are detachable, these and the clamping plates and wing nuts can be easily lost.

Figure 2:
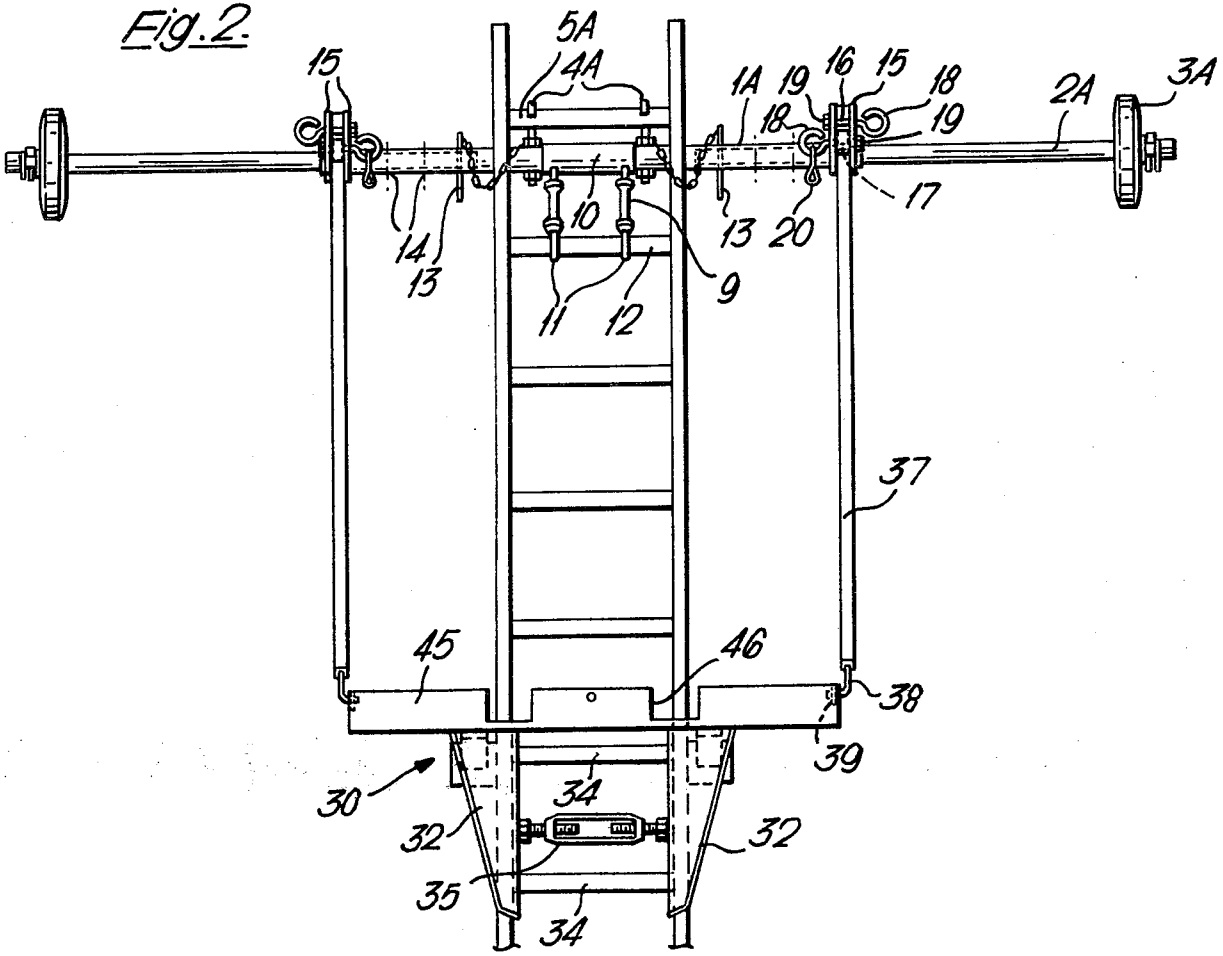
FIG. 2 is an elevation showing the ladder attachment according to the invention mounted on a ladder and also a platform unit according to the invention in use in conjunction with the ladder attachment.
Figure 3:
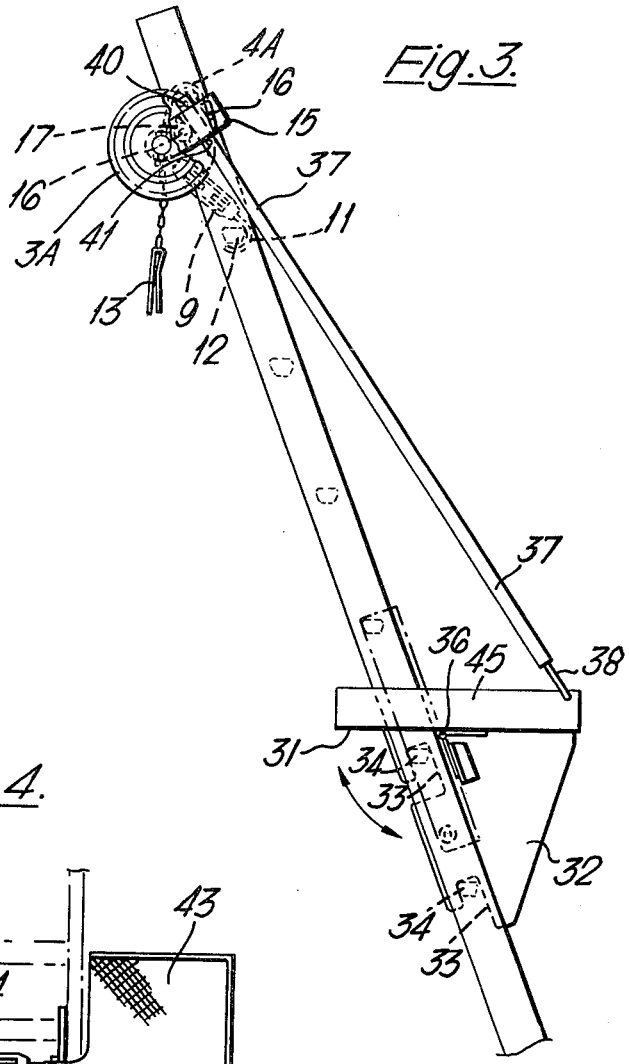
FIG. 3 is a side view corresponding to FIG. 2.
Figure 4:
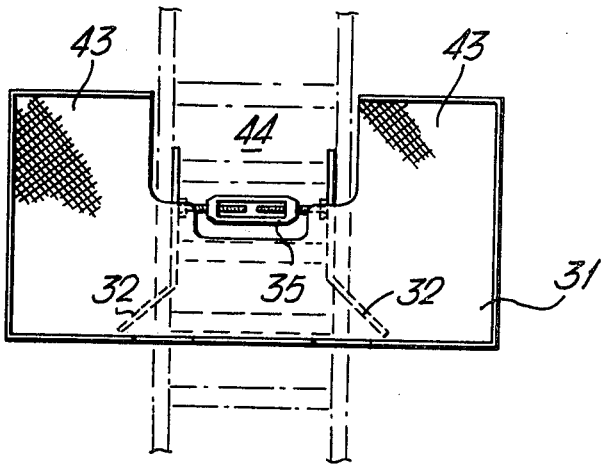
FIG. 4 is a plan view of the platform.

Reference will now be made to FIGS. 2 to 4 in which parts corresponding to those in FIG. 1 are indicated by the same numerals with the addition of the suffix A.

In FIGS. 2 and 3 the hook-shaped members 4A engage over the top rung 5A, and the U-shaped brackets are replaced by a pair of turnbuckles 9. The latter are connected at their upper ends to a sleeve 10 carried on the central part of the bar 1A, and, at their lower ends, they have hooks 11. The sleeve 10 is freely rotatable. When the upper hooks 4A are located over rung 5A the lower hooks 11 are located under the next lower rung 12, and the turnbuckle sleeves 13 are turned by hand to shorten the turnbuckles and bring the hooks 11 firmly into engagement with rung 12.

The bar 1A carries a pair of generally elongate R-shaped pins 13 each attached to a chain secured to the bar. Each R-pin is used to secure the respective telescopic bar 2A to the bar 1A, for this purpose, the bar 1A has a series of through holes 14 and each telescopic bar 2A has a through hole which can align with any one of the holes 14 so as to extend the desired length from the bar 1A. The straight leg of the R-pin is pushed through the aligned holes and the bent part tightly engages the outer face of the bar 1A.

The telescopic bars have a maximum spread between their wheels 3A of, e.g. 2.4 m and a minimum of e.g. 1.4 m.

Mounted at each end of bar 1A may be a pair of lugs 15; these are optional, but if the platform assembly 30, hereinafter described, is to be used in conjunction with the ladder attachment, these lugs 15 are required.

The lugs are welded to the bar 1A to lie at an angle to the vertical when the attachment is in use; the lugs extend upwards and 'rearwards' i.e. away from the wall against what the ladder is placed.

Each pair of lugs 15 has two pins 16 passing through them, the lower pin carrying a roller 17. Each pin terminates at one end in a ring 18 and the other end carries a nut 19. One ring 18, the lower one, is located inwards and carries a clasp 20 for attachment of a safety harness; the other ring extends outwards and can carry a pulley block by which goods can be hoisted from the ground to a person working on the ladder.

From the above, it will be seen that the device is much more firmly secured to the ladder than hitherto. Thus, as the turnbuckle 9 and the shanks of the hook-shaped members 4A extend in a direction longitudinally of the ladder, the clamping force is also in that direction, as distinct from the known arrangement in which the clamping force is transversely from front to rear of the ladder. Moreover, the hook-shaped members 4A, the turnbuckles 9 and the R-pins 16 are all anchored to the bar 1A, so that there is virtually no possibility of them being lost.

The hook-shaped members 4A may be secured to the bar 1A by nuts, so that their height can be adjusted, if necessary. Preferably however, they are welded to the bar 1A.

The hooks 11 on the turnbuckles 9 may be fitted to the rung 12 the other way round, so that the shank of the hooks pass in front of the rung 12 and the hooked portions project rearwardly.

The ladder attachment may be used with or without a platform assembly which is releasably attached to the ladder, as will now be described.

The platform assembly 30 includes a platform 31 having a support framework which includes side members 32 having slots 33 for engaging a pair of rungs 34 below the level of the ladder attachment. The upper slot is right-angled to give a bayonet-joint effect for secure fitment. The sides 32 are laterally adjustable by means of a turnbuckle 35 so that they can be pressed close against its inner face of the ladder sides.

The platform 31 is hinged at 36 to the support framework so that it can be tilted upwards to overlie the next higher rung of the ladder; this is to allow a person to climb past the platform after which the platform can be kicked back into the framework for the person to stand on it. The platform lies horizontal when the ladder is at an angle of 70° to the horizontal.

A pair of support struts 37 are also provided. The lower end of each strut carries a threaded bolt 38 which is bent to engage in a hole in the "rear" end of the platform, i.e. the end remote from the ladder. The strut is secured by a split pin 39 passed through a hole therein.

The upper end of the strut passes through the gap between the pin 16 and the roller 17 of the respective pair of lugs 15 on the bar 1A. A split pin 40 is located in a hole in a strut above the lugs as a precautionary measure to prevent the possibility of the strut moving downwards out of the gap. After the platform has been kicked down, a split pin 41 is placed in a hole in the strut below the lugs to prevent upward movement of the strut and consequently tilting of the platform 31.

The platform 31 has a width of about 1 meter and a pair of wings 42 at each end extend forward to a depth of ½ meter. This leaves a central gap 44 on the ladder side of the platform so that the wings extend forwardly of each side of the ladder.

The platform 31 has a upstanding surround 45 which is recessed 46 at two places along the rear wall so that the surround does not foul the ladder sides when the platform is tilted upwards.

The ladder attachment and the platform assembly are preferably made of aluminium.

The ladder attachment and platform can be fitted to the ladder either before the ladder is raised, i.e. when it is on the ground, or after the ladder is raised. To fit the ladder attachment to a raised ladder, the ladder is either set at a shallow angle of say 50° and supported from slipping so that a person can carry the attachment up the ladder and secure it to the rungs, after which the person can descend and the ladder raised to its working angle of 70°.

Figure 5:
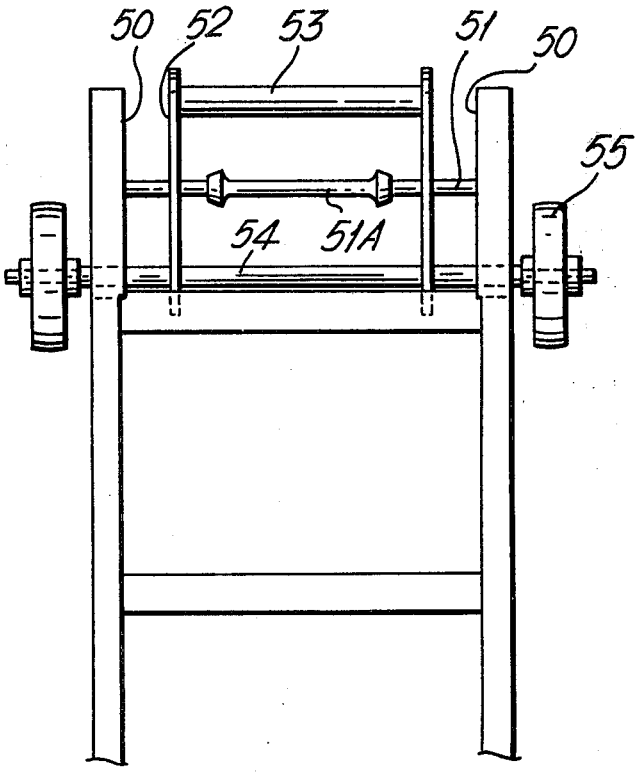
FIG. 5 is an elevation showing a spacing device used while fitting the ladder attachment to a ladder.
Figure 6:
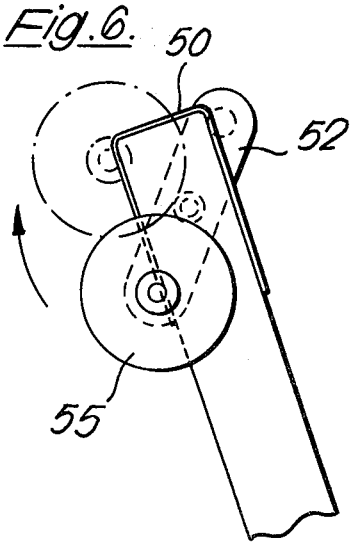
FIG. 6 is a side view corresponding to FIG. 5.

Alternatively, a spacer device can be temporarily mounted to the top of the ladder so as to space the ladder from the wall and allow fitment of the attachment. A ladder suitable spacer is illustrated in FIGS. 5 and 6 and consists of a pair of metal plates 50 which slide over the ends of the ladder sides.

A shaft 51 is mounted between the sleeves and has a turnbuckle 51A so that the sleeves can be heightened against the ladder. The shaft also carries a pair of pivotal cross pieces 52. A handle 53 is located at one end of the cross pieces and an axle 54 carrying wheels 55 is located at the other end. With the spacer fitted to the ladder, the ladder placed against the wall so that the wheels 55 engage the wall, a person can climb to the top of the ladder, and by pulling down on the handle 53 the wheels 55 are swung upwards in contact with the wall thus causing the top of the ladder to move a short distance away from the wall. The weight of the ladder on the spacer retains the wheels in the raised 'spacing' position.

The ladder attachment can now be fitted as follows, having first set the exterior bars 2A are set at the desired width position in the bar 1A. A person then carries the attachment to the top of the ladder and the attachment is hooked on to the top rung 5A, (if a pulley is readily available the attachment can be hoisted up the ladder, using the ladder sides as rails). The turnbuckles 9 hang down on their sleeve 10 and can be easily located under the next lower rung 12, after which the turnbuckles are tightened. The spacer can then be removed.

The platform assembly is then carried up the ladder and the framework sides 32 lowered on to the appropriate rungs. The sides are then pressed against the ladder sides by adjusting the turnbuckle 35.

If the platform assembly is to be used, the struts 37 are located within the lugs 15 of the ladder attachment, and the upper pin 40 inserted into the struts so that they hang down from the attachment and the bolt 38 is length adjusted if necessary before being connected and secured to the platform 31.

The platform is then tilted upwards, which causes the struts 37 to slide upwards between their lugs, and the person climbs above the plarform, kicks it down and inserts the lower pins 41 into the struts.

The platform is then ready for use. If the user is wearing a safety harness the straps thereof can be clipped to each harness clasp 20. Alternatively, a strap can be passed throught the clasps 20 round the front of the ladder, and the ends can be attached to the users harness.

If the ladder attachment and platform assembly are to be mounted on the ladder while it is lying on the ground, the ladder is placed at 90° to the wall with the top of the ladder close to the wall. Thus, when the ladder attachment is fitted (to the underside of the ladder), the top can be raised and the ladder gradually rolled up the wall by means of the wheels 3A.

In use, a person can move about the platform and can stand at one side or the other, due to the stability given to the ladder by the ladder attachment and the secure fixing by which the platform assembly is mounted on the ladder. Consequently a far greater area is within the user's reach than would be the case if the person was standing on the ladder rungs. The struts 37 not only connect the platform to the ladder attachment, but also act as side barriers for the further protection of a person standing on the platform.

If a pulley is suspended from the pulley ring 18 goods can be hoisted up to the user; this also is possible because of the stability given by the attachment and the secure fixing by which it is mounted on the ladder.

I claim:

1. A ladder attachment comprising an elongate cross-bar whose length is greater than the width of the ladder, attachment means mounted on the cross-bar for securing the cross-bar to at least two rungs of the ladder, a platform assembly which includes a framework having recesses for engagement with at least one other ladder rung extending below said two rungs and supporting a platform member, and support means connecting the platform assembly to the cross-bar.

2. A platform assembly as claimed in claim 1 wherein said cross-bar comprises a central tubular member and a pair of outer wall-engageable members telescopically mounted in the central member and adjustably locatable therein.

3. A platform assembly as claimed in claim 1 or 2 wherein said attachment means comprising at least one hook-shaped member for engaging one rung and a pair of turnbuckles which at one end are mounted on the cross-bar and at their other end have hooks for engaging another rung, such that the cross-bar lies between said two rungs.

4. A ladder attachment as claimed in claim 1, in which the turnbuckles are fixedly mounted on a sleeve rotatably carried by the central member of the cross-bar.

5. A platform assembly as claimed in claim 1, in which the support means comprises a pair of struts connected to the platform member and to bracket means mounted on the cross-bar.

6. A platform assembly as claimed in claim 5, in which the platform member is pivotal upwardly relative to the ladder and the struts are slidably located in the bracket means.

7. A platform assembly as claimed in claim 1 in which the platform member has a width approximately three times the width of the ladder.

* * * * *